US010706747B2

(12) United States Patent
Santoro

(10) Patent No.: US 10,706,747 B2
(45) Date of Patent: Jul. 7, 2020

(54) PYRAMIDICAL DISPLAYS AND METHODS FOR FORMING THE SAME

(71) Applicant: R.R. Donnelley & Sons Company, Chicago, IL (US)

(72) Inventor: Marcellino Santoro, Bartlett, IL (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 16/201,535

(22) Filed: Nov. 27, 2018

(65) Prior Publication Data

US 2020/0168127 A1 May 28, 2020

(51) Int. Cl.
*G09F 1/08* (2006.01)

(52) U.S. Cl.
CPC ..... *G09F 1/08* (2013.01)

(58) Field of Classification Search
CPC .... A47F 5/00; G09F 15/0075; G09F 15/0056; G09F 15/0062; G09F 7/18; G09F 7/02; A09F 1/06; A09F 1/065
See application file for complete search history.

(56) References Cited

U.S. PATENT DOCUMENTS

| | | | |
|---|---|---|---|
| 1,028,147 A | 6/1912 | Stranders | |
| 1,670,464 A | 12/1923 | Marsh | |
| 1,545,771 A | 7/1925 | Hout | |
| 1,576,672 A | 3/1926 | Miller | |
| 1,656,341 A | 1/1928 | Smith | |
| 1,687,616 A | 10/1928 | Huye | |
| 1,902,566 A | 3/1933 | Marsh | |
| 2,108,349 A * | 2/1938 | Rasmussen | A47F 5/00 211/72 |
| 2,113,288 A | 4/1938 | Berger | |

(Continued)

FOREIGN PATENT DOCUMENTS

| | | |
|---|---|---|
| CN | 1387175 A | 12/2002 |
| CN | 101061527 A | 10/2007 |

(Continued)

OTHER PUBLICATIONS

International Seraching Authority, "International Search Report and Written Opinion," issued in connection with the International Application No. PCT/US2016/064478, dated Jan. 24, 2017, 15 pages.

(Continued)

*Primary Examiner* — Cassandra Davis
(74) *Attorney, Agent, or Firm* — Hanley, Flight & Zimmerman, LLC

(57) ABSTRACT

Pyramidical displays and methods for forming the same are disclosed. An example apparatus includes a first panel, a second panel, a third panel, and a fourth panel, when in an erected position, the first panel, the second panel, the third panel and the fourth panel form a first cross-section at a first height and a second cross-section at a second height, the first cross-section having a greater area than the second cross-section, the first height lower than the second height. The example apparatus includes a first stop extending between a first vertex between the first panel and the third panel and a second vertex between the second panel and the fourth panel, the first stop to prevent movement of the first panel about the first vertex.

17 Claims, 10 Drawing Sheets

(56) References Cited

U.S. PATENT DOCUMENTS 2,142,826 A 1/1939 Rosello
2,153,460 A 4/1939 Giles
2,210,317 A 8/1940 Dueringer
2,283,406 A 5/1942 Bacon
2,290,144 A 7/1942 Katz
2,404,089 A 7/1946 Pollock
2,601,374 A 6/1952 Ditzler et al.
2,637,924 A 5/1953 Hutt
2,728,461 A 12/1955 Paige
2,773,324 A 12/1956 Drueck, Jr.
2,833,074 A 5/1958 Jannes
2,892,276 A 6/1959 Nelson
2,918,178 A 12/1959 Leone
2,984,920 A 5/1961 Acosta et al.
3,015,898 A 1/1962 Keeslar
3,091,877 A 6/1963 Luchsinger
3,234,682 A 2/1966 Frankl
3,267,597 A 8/1966 Jannes
3,302,321 A 2/1967 Walker
3,571,958 A 3/1971 Trevor
3,665,669 A 5/1972 Huber
3,666,607 A 5/1972 Weissman
4,234,148 A 11/1980 Maddestra et al.
4,610,363 A 9/1986 Flum et al.
4,619,426 A 10/1986 Drueck, Jr.
4,750,283 A 6/1988 Halpern
4,770,379 A 9/1988 Estvold
4,773,622 A 9/1988 Herlin
4,774,780 A 10/1988 Crowell
4,790,714 A 12/1988 Schnapp
4,854,060 A 8/1989 Corbo et al.
4,940,199 A 7/1990 Hall
4,984,848 A 1/1991 Scalisi et al.
4,993,846 A 2/1991 Diamond et al.
5,000,717 A 3/1991 Pfeiffer
5,090,349 A * 2/1992 Wilson ..... E01F 9/654 116/63 C
5,193,466 A 3/1993 Eder
5,197,631 A 3/1993 Mishima
5,297,677 A 3/1994 Burian et al.
5,416,997 A 5/1995 Dyment et al.
5,454,180 A 10/1995 Volpe
5,467,547 A 11/1995 Fortner
5,632,390 A 5/1997 Podergois
5,752,649 A 5/1998 Weder
5,758,438 A 6/1998 Crowell
5,778,959 A 7/1998 Guetschow
5,787,621 A 8/1998 Leksell
5,809,673 A 9/1998 Johnson et al.
5,868,367 A 2/1999 Smith
5,878,945 A 3/1999 Weder
5,937,553 A 8/1999 Maran
5,966,857 A 10/1999 Pettersson et al.
5,983,538 A 11/1999 Crowell
6,311,418 B1 11/2001 Crowell
6,347,772 B1 2/2002 L'Hotel
6,497,601 B1 12/2002 Ward
7,134,230 B1 11/2006 Boens et al.
7,159,350 B2 1/2007 L'Hotel
7,234,253 B2 6/2007 Ossmann
7,437,842 B2 10/2008 Sgambellone
7,634,865 B2 12/2009 L'Hotel
7,726,054 B2 6/2010 Mestres Armengol et al.
7,774,964 B2 * 8/2010 L'Hotel ..... G09F 1/065 40/539
7,980,013 B2 7/2011 Hsu
7,980,016 B2 7/2011 L'Hotel
8,099,883 B2 1/2012 Mestres Armengol et al.
8,112,925 B2 2/2012 Tzuo
8,228,410 B2 7/2012 Raynor et al.
8,291,631 B2 10/2012 Wilder
8,458,939 B2 6/2013 Arthur et al.
8,590,188 B2 11/2013 Mirsch
8,701,321 B2 4/2014 Da Fonseca et al.
8,776,415 B2 7/2014 Kawaguchi et al.
8,826,833 B1 9/2014 Fischer et al.
8,863,418 B2 10/2014 Acker et al.
8,875,908 B2 11/2014 L'Hotel
9,123,262 B1 9/2015 Frost
9,173,485 B2 11/2015 Fischer et al.
9,569,160 B2 2/2017 Tsuchida et al.
9,715,840 B1 7/2017 Warmus
9,734,734 B2 8/2017 Lyon
9,779,640 B2 10/2017 Ruhaak
9,812,038 B2 11/2017 Lyon
9,978,292 B2 5/2018 Santoro, Jr.
10,008,138 B2 6/2018 Bonifas
10,170,020 B2 1/2019 Cwidak et al.
10,223,939 B2 3/2019 Warmus
2004/0111930 A1 6/2004 Ossmann
2006/0260165 A1 11/2006 Chenel
2007/0245610 A1 10/2007 Mestres Armengol et al.
2007/0294925 A1 12/2007 L'Hotel
2008/0066353 A1 3/2008 Mills
2008/0083146 A1 4/2008 Martin Presa
2010/0043261 A1 2/2010 Arthur et al.
2010/0072330 A1 3/2010 Tzuo
2010/0236117 A1 9/2010 Mestres Armengol et al.
2011/0088300 A1 * 4/2011 Martin Presa ..... G09F 1/06 40/606.12
2011/0179685 A1 7/2011 Mirsch
2012/0012734 A1 1/2012 Tzuo
2012/0227297 A1 9/2012 Kawaguchi et al.
2013/0192110 A1 8/2013 Da Fonseca et al.
2013/0219760 A1 8/2013 Acker et al.
2014/0205772 A1 7/2014 Sitton
2014/0265777 A1 9/2014 Fischer et al.
2015/0265070 A1 9/2015 Mestres Armengol et al.
2016/0335925 A1 11/2016 Ruhaak
2016/0335934 A1 11/2016 Lyon
2016/0335935 A1 11/2016 Lyon
2017/0193866 A1 7/2017 Bonifas
2017/0213485 A1 * 7/2017 Santoro, Jr. ..... G09F 1/065
2017/0249874 A1 * 8/2017 Lopez Fern Ndez ... G09F 1/065
2017/0294149 A1 10/2017 Lyon
2018/0040262 A1 2/2018 Lyon
2018/0075781 A1 * 3/2018 Cwidak ..... G09F 1/065
2018/0075788 A1 3/2018 Warmus et al.
2018/0122272 A1 5/2018 Warmus
2018/0211571 A1 * 7/2018 Enriquez ..... G09F 1/065
2018/0268748 A1 * 9/2018 Enriquez ..... G09F 15/0062
2019/0066550 A1 2/2019 Enriquez
2019/0279534 A1 9/2019 Lyon

FOREIGN PATENT DOCUMENTS

CN 101473360 A 7/2009
CN 102005160 A 4/2011
CN 202711641 U 1/2013
CN 203192354 9/2013
CN 204257165 U 4/2015
CN 205722637 11/2016
DE 2658506 1/1978
DE 4005925 10/1991
DE 4314654 11/1994
DE 9320993 8/1995
DE 202010015312 1/2011
DE 202011002980 4/2011
DE 202014106297 3/2015
DK 9500055 5/1995
DK 9500277 9/1995
EP 1741368 1/2007
EP 1830334 9/2007
EP 1926076 5/2008
EP 2290637 3/2011
EP 2400477 12/2011
ES 2212927 8/2004
ES 2255857 7/2006
FR 1254983 3/1961
FR 2210317 6/1974
FR 2232259 12/1974
FR 2233912 1/1975
FR 2571949 4/1986
FR 2574968 6/1986

(56) References Cited

FOREIGN PATENT DOCUMENTS

| | | | | |
|---|---|---|---|---|
| FR | 2650907 | | 2/1991 | |
| FR | 2680030 | | 2/1993 | |
| FR | 2691621 | | 12/1993 | |
| FR | 2730148 | | 8/1996 | |
| FR | 2735264 | | 12/1996 | |
| FR | 2745109 | | 8/1997 | |
| FR | 2760801 | | 9/1998 | |
| FR | 2760802 | | 9/1998 | |
| FR | 2760880 | | 9/1998 | |
| FR | 2770320 | | 4/1999 | |
| FR | 2911425 | | 7/2008 | |
| FR | 2925203 | | 6/2009 | |
| FR | 2925204 | | 6/2009 | |
| FR | 2929035 | A1 * | 9/2009 | ..... G09F 1/06 |
| FR | 2948222 | | 1/2011 | |
| GB | 463574 | | 4/1937 | |
| GB | 740577 | | 11/1955 | |
| GB | 743378 | | 1/1956 | |
| GB | 824004 | | 11/1959 | |
| GB | 1034280 | | 6/1966 | |
| GB | 1272187 | | 4/1972 | |
| GB | 1317155 | | 5/1973 | |
| JP | 2003530602 | | 10/2003 | |
| WO | 9634379 | | 10/1996 | |
| WO | 9936900 | | 7/1999 | |
| WO | 02095719 | | 11/2002 | |
| WO | 2004044867 | | 5/2004 | |
| WO | 2006040438 | | 4/2006 | |
| WO | 2006067252 | | 6/2006 | |
| WO | 2007138083 | | 12/2007 | |
| WO | 2008049176 | | 5/2008 | |
| WO | 2008125703 | | 10/2008 | |
| WO | 2010019086 | | 2/2010 | |
| WO | 2010130485 | | 11/2010 | |
| WO | 2011092209 | | 8/2011 | |
| WO | 2011113123 | | 9/2011 | |
| WO | 2012061375 | | 5/2012 | |
| WO | 2012164114 | | 12/2012 | |
| WO | 2016057067 | | 4/2016 | |
| WO | 2016071868 | | 5/2016 | |
| WO | 2017116605 | | 6/2017 | |
| WO | 2017116605 | | 7/2017 | |
| WO | 2018027118 | | 2/2018 | |

OTHER PUBLICATIONS

International Seraching Authority, "International Search Report," issued in connection with the International Application No. PCT/US2017/045471, dated Oct. 18, 2017, 5 pages.

International Seraching Authority, "Written Opinion," issued in connection with the International Application No. PCT/US2017/045471, dated Oct. 18, 2017, 5 pages.

China National Intellectual Property Administration (CNIPA), "First Office Action," dated Oct. 24, 2019, in connection with Chinese Patent Application No. 201810209272.0, 13 pages (Full document and English translation).

China National Intellectual Property Administration (CNIPA), "Notice of Allowance," dated Nov. 12, 2019 in connection with Chinese Patent Application No. 201710340752.6, 7 pages (full document and English translation).

United States Patent and Trademark Office, "Corrected Notice of Allowance," dated Dec. 26, 2019 in connection with U.S. Appl. No. 15/261,191, 3 pages.

United States Patent and Trademark Office, "Non-Final Office Action," issued in connection with U.S. Appl. No. 14/709,266, dated May 23, 2016, 11 pages.

United States Patent and Trademark Office, "Notice of Allowance," issued in connection with U.S. Appl. No. 14/709,266, dated Sep. 26, 2016, 20 pages.

United States Patent and Trademark Office, "Non-Final Office Action," issued in connection with U.S. Appl. No. 14/709,285, dated Sep. 15, 2016, 8 pages.

United States Patent and Trademark Office, "Non-Final Office Action," dated Sep. 16, 2016 in connection with U.S. Appl. No. 14/711,739, 7 pages.

United States Patent and Trademark Office, "Non-Final Office Action," dated Dec. 1, 2016 in connection with U.S. Appl. No. 15/229,920, 7 pages.

United States Patent and Trademark Office, "Final Office Action," dated Mar. 15, 2017 in connection with U.S. Appl. No. 14/709,285, 7 pages.

United States Patent and Trademark Office, "Notice of Allowance," issued in connection with U.S. Appl. No. 15/229,920, dated Mar. 22, 2017, 7 pages.

United States Patent and Trademark Office, "Final Office Action," issued in connection with U.S. Appl. No. 14/711,739, dated Mar. 21, 2017, 6 pages.

United States Patent and Trademark Office, "Non-final Office Action," issued in connection with U.S. Appl. No. 14/988,616, dated Apr. 11, 2017, 8 pages.

United States Patent and Trademark Office, "Notice of Allowance," issued in connection with U.S. Appl. No. 14/709,266, dated Apr. 12, 2017, 5 pages.

United States Patent and Trademark Office, "Notice of Allowance," issued in connection with U.S. Appl. No. 14/709,285, dated Jul. 3, 2017, 8 pages.

United States Patent and Trademark Office, "Non-Final Office Action," dated Aug. 4, 2017 in connection with U.S. Appl. No. 15/415,587, 9 pages.

United States Patent and Trademark Office, "Non-Final Office Action," dated Sep. 29, 2017 in connection with U.S. Appl. No. 15/261,178, 11 pages.

United States Patent and Trademark Office, "Final Office Action," dated Apr. 11, 2018 in connection with U.S. Appl. No. 15/261,178, 12 pages.

United States Patent and Trademark Office, "Notice of Allowance," issued in connection with U.S. Appl. No. 14/988,616, dated Feb. 28, 2018, 8 pages.

United States Patent and Trademark Office, "Notice of Allowance," dated Jan. 19, 2018 in connection with U.S. Appl. No. 15/415,587, 7 pages.

United States Patent and Trademark Office, "Non-Final Office Action," dated Apr. 9, 2018 in connection with U.S. Appl. No. 15/634,974, 7 pages.

United States Patent and Trademark Office, "Notice of Allowance," dated Aug. 3, 2018 in connection with U.S. Appl. No. 15/261,178, 5 pages.

United States Patent and Trademark Office, "Notice of Allowance," dated Feb. 1, 2019 in connection with U.S. Appl. No. 15/786,405, 9 pages.

United States Patent and Trademark Office, "Notice of Allowance," dated Jul. 1, 2019 in connection with U.S. Appl. No. 15/261,191, 7 pages.

United States Patent and Trademark Office, "Non-Final Office Action," dated Jan. 23, 2019 in connection with U.S. Appl. No. 15/261,191, 10 pages.

State Intellectual Property Office of the People's Republic of China, "Notice of Allowance," dated Mar. 16, 2018 in connection with Chinese Patent Application No. 201720947684.5, 4 pages, (full document and English translation).

United States Patent and Trademark Office, "Non-Final Office Action," dated Oct. 2, 2018, in connection with U.S. Appl. No. 15/786,405, 8 pages.

State Intellectual Property Office of the People's Republic of China, "First Office Action," dated May 24, 2019 in connection with Chinese Patent Application No. 201710340752.6, 25 pages (no translation available).

United States Patent and Trademark Office, "Notice of Allowance," dated Sep. 21, 2018 in connection with U.S. Appl. No. 15/909,155, 7 pages.

United States Patent and Trademark Office, "Non-Final Office Action," dated Jun. 25, 2018 in connection with U.S. Appl. No. 15/690,031, 8 pages.

(56) References Cited

OTHER PUBLICATIONS

United States Patent and Trademark Office, "Final Office Action," dated Feb. 25, 2019 in connection with U.S. Appl. No. 15/690,031, 9 pages.
United States Patent and Trademark Office, "Non-Final Office Action," dated Apr. 5, 2018 in connection with U.S. Appl. No. 15/657,548, 8 pages.
United States Patent and Trademark Office, "Notice of Allowance," dated Oct. 23, 2018 in connection with U.S. Appl. No. 15/657,548, 8 pages.
United States Patent and Trademark Office, "Notice of Allowance," issued in connection with U.S. Appl. No. 14/711,739, dated Jun. 8, 2017, 9 pages.
United States Patent and Trademark Office, "Final Office Action," dated Oct. 25, 2018 in connection with U.S. Appl. No. 15/634,974, 8 pages.
United States Patent and Trademark Office, "Advisory Action," dated Jun. 11, 2019 in connection with U.S. Appl. No. 15/690,031, 3 pages.
United States Patent and Trademark Office, "Non-Final Office Action," dated Sep. 19, 2019 in connection with U.S. Appl. No. 15/415,594, 7 pages.
United States Patent and Trademark Office, "Restriction Requirement," dated Aug. 31, 2018 in connection with U.S. Appl. No. 15/261,191, 5 pages.
United States Patent and Trademark Office, "Non-Final Office Action," dated Oct. 2, 2019 in connection with U.S. Appl. No. 16/421,116, 7 pages.
United States Patent and Trademark Office, "Non-Final Office Action," dated Oct. 11, 2019 in connection with U.S. Appl. No. 15/690,031, 7 pages.
United States Patent and Trademark Office, "Final Office Action," issued in connection with U.S. Appl. No. 14/988,616, dated Oct. 30, 2017, 9 pages.
United States Patent and Trademark Office, "Notice of Allowance," dated Oct. 17, 2019 in connection with U.S. Appl. No. 15/261,191, 6 pages.
United States Patent and Trademark Office, "Notice of Allowance," dated Feb. 6, 2020 in connection with U.S. Appl. No. 16/421,116, 7 pages.
United States Patent and Trademark Office, "Notice of Allowance," dated Mar. 30, 2020 in connection with U.S. Appl. No. 15/690,031, 6 pages.
China National Intellectual Property Administration (CNIPA), "Notice of Allowance," dated Mar. 27, 2020, in connection with Chinese Patent Application No. 201810209272.0, 6 pages (Including English translation).
United States Patent and Trademark Office, "Notice of Allowance," dated Apr. 8, 2020 in connection with U.S. Appl. No. 15/415,594, 8 pages.
United States Patent and Trademark Office, "Corrected Notice of Allowability," dated May 15, 2020 in connection with U.S. Appl. No. 16/421,116, 2 pages.

* cited by examiner

PYRAMIDICAL DISPLAYS AND METHODS FOR FORMING THE SAME

FIELD OF THE DISCLOSURE

This disclosure relates generally to displays and, more particularly, to pyramidical displays and methods of making such pyramidical displays.

BACKGROUND

Displays may be used at a point of sale to provide advertising or other information on outer surfaces of a shroud defining a structure for the display.

BRIEF DESCRIPTION OF THE DRAWINGS

The figures are not to scale. Instead, the thickness of the layers or regions may be enlarged in the drawings. In general, the same reference numbers will be used throughout the drawing(s) and accompanying written description to refer to the same or like parts.

DETAILED DESCRIPTION

Figure 1:
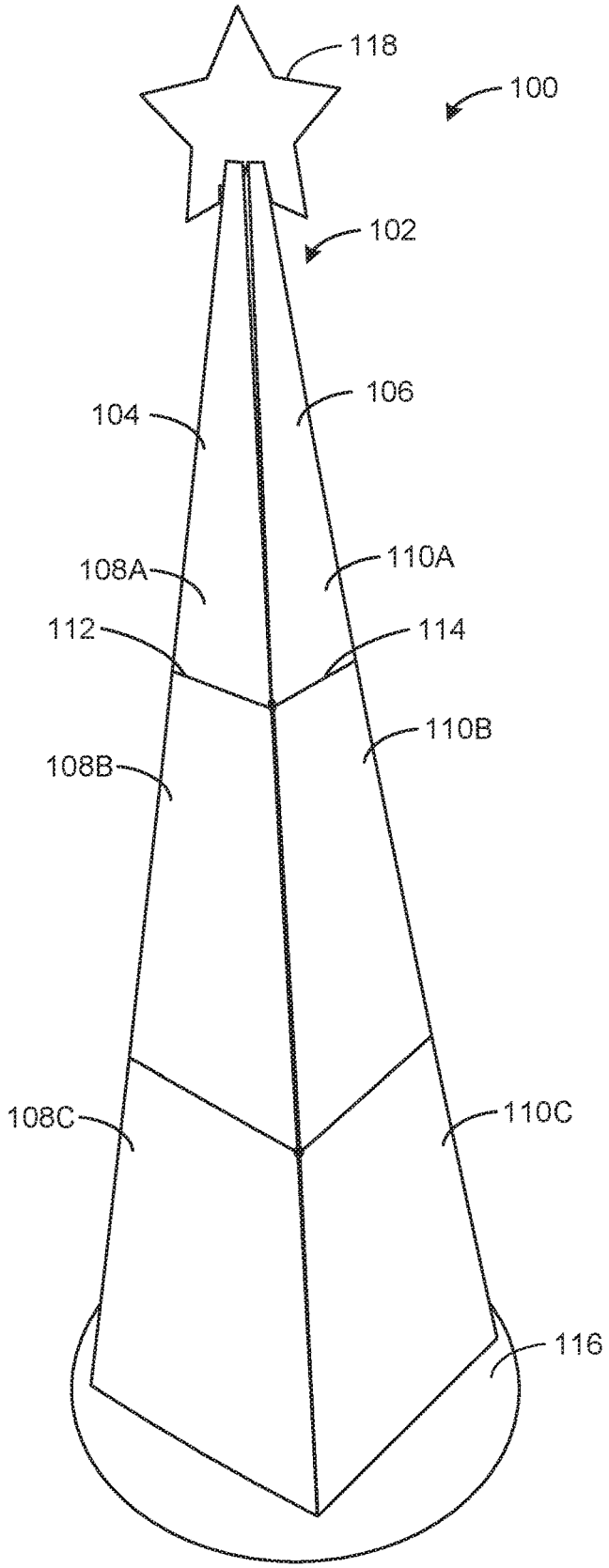
FIG. 1 is a perspective view of an example pyramidical display in accordance with the teachings of this disclosure.

The examples disclosed herein relate to pyramidical displays that can be used for point-of-sale advertising, providing information, and/or for other suitable purposes. In some examples, the pyramidical display can be shipped to a customer in a folded, flat state. The example displays disclosed herein are configured to be collapsed to a folded, substantially flat state, which facilitates shipping and transport, and to be readily erected or deployed at a location (e.g., a point-of-sale, a conference booth, a store, etc.) to affect a desired display function.

In some examples disclosed herein, the example displays include one or more substrates (e.g., a sheet material, a panel, etc.) that, singly or in combination, form a shroud into which one or more internal support members are disposed or are able to be disposed. In some examples, the substrate(s) can include card stock, paperboard, corrugated fiberboard, and/or any other suitable material or combination of materials. In some examples, the substrates can include one or more panels. In some examples, the shroud is composed of four panels, which when erected from the cross-section of the display. In other examples, the shroud is composed of a first panel, a second panel and a third panel, wherein the third panel is composed a first subpanel and a second subpanel.

In some examples, the deployed shroud defines a generally quadrilateral cross-section which may approximate, for example, a rectangle, a square, a rhombus, a rhomboid, a trapezium, or a trapezoid. In other examples, the deployed shroud defines other polygonal cross-sections or a generally triangular cross-section. In some examples, the deployed shroud forms a tetrahedral or polyhedral display.

In some examples, the dimensions, area, and/or shape of the cross-section of display can vary along a vertical axis of the display. For example, the cross-sectional area of the display can at a first height can be greater the cross-section area of the display area of the display at a second height, where the first height is greater than the second height. In other examples, the cross-sectional area of the display at a first height can be greater the cross-sectional area of the display area of the display at a second height, where the first height is less than the second height.

A base structure is optionally attached to or integrated with one or more portions of the shroud, such as a base portion, to help to maintain the shroud in a desired orientation. In some examples, the base structure can include card stock, paperboard, corrugated fiberboard, and/or any other suitable material or combination of materials.

One or more top element(s) is optionally attached to or integrated with one or more portions of the shroud. In some examples, the top element is included for aesthetic or decorative reasons. For example, the top element can be a decorative element formed in a holiday themed shape (e.g., an angel, a star, an ornament, etc.). In some examples, the top element can include card stock, paperboard, paper, corrugated fiberboard, and/or suitable material or combination of materials. In some examples, graphics (e.g., an advertisement, information, etc.) can be disposed onto the surface of the shroud(s), base and/or top element(s).

In some examples disclosed herein, a pyramidical display is formed by assembling one or more substrates together with one or more stops disposed within the interior of the display. In some examples disclosed herein, the example pyramidical displays can include one or more elastic elements (e.g., elastic bands, rubber bands, latex bands, etc.) that are in a state of tension when the display is erected. In this example, the force imparted by the elastic elements urges one or more elements of the display to remain in the erected position. In other examples, any other fastener(s) can be used to hold the display in the erected position (e.g., adhesive, cable tie(s), hook and loop fastener(s), staple(s), pin(s), staple(s), twist ties, etc.). Additionally or alternatively, a chemical adhesive can be used to hold elements of the display in the erected position (e.g., glue, rubber cement, resin, polymers, etc.).

FIG. 1 is a perspective view of an example pyramidical display 100 in accordance with the teachings of this disclosure. In the illustrated example, the display 100 includes an example shroud 102 that is formed by an example first substrate 104 and an example second substrate 106. In other examples, the shroud 102 can be formed by a single substrate, three substrates, or any other suitable number of substrates. In some examples, at least one of the first substrate 104 and the second substrate 106 can include features that enable the coupling of the example substrates 104, 106 (e.g., portions of one or more of the substrates 104, 106 can enable the coupling of the substrates 104, 106 via elastic elements, adhesive, etc.).

In the illustrated example, the first substrate 104 includes an example first segment 108A, an example second segment 108B, and an example third segment 108C. The second substrate 106 includes an example first segment 110A, an example second segment 110B, and an example third segment 110C. Additionally or alternatively, the example first substrate 104 and the example second substrate 106 can include any other suitable number of segments (e.g., one segment, two segments, four segments, etc.). In the illustrated example, the first substrate 104 and the second substrate 106 have the same quantity of segments. In other examples, the first substrate 104 and the second substrate 106 can have different numbers of segments. In the illustrated example, the first substrate 104, the second substrate 106, the first segments 108A, 110A, the second segments 108B, 110B, and the third segments 108C, 110C are trapezoidal. In other examples, the first substrate 104, the second substrate 106, the first segments 108A, 110A, the second segments 108B, 110B, and the third segments 108C, 110C can be any other suitable shape to form the pyramidical display 100 (e.g., triangular, etc.).

In the illustrated example, each segment (e.g., the first segment 108A, etc.) of a substrate (e.g., the first substrate 104) is hinged to an adjacent segment by a line of weakness to form a joint to facilitate the erection of the display 100. For example, the first segment 108A of the first substrate 104 is hinged to the second segment 108B of the first substrate 104 by an example line of weakness 112. In the illustrated example, each line of weakness is formed in the substrates 104, 106 in substantially the same position along the vertical axis of the display 100 with one another to facilitate folding of the shroud 102. For example, the line of weakness 112 (e.g., hinging the first segment 108A of the first substrate 104 to the second segment 108B of the first substrate 104) is at substantially the same vertical height as an example line of weakness 114, which hinges the first segment 110A of the second substrate 106 to the second segment 110B of the second substrate 106.

The example pyramidical display 100 further includes an example base 116 and an example top element 118. In other examples, the pyramidical display 100 may not include the example base 116 and/or example top element 118. An example implementation of the base 116 is described below in conjunction with FIG. 6.

In the illustrated example, the top element 118 is affixed to a top edge of a substrate (e.g., the example first substrate 104, the example second substrate 106, etc.) of the pyramidical display 100. In some examples, the top element 118 can be composed of the same material as one, some or all the substrates 104, 106. In other examples, the top element 118 can be composed of any suitable material(s) (e.g., cardboard, paperboard, paper, corrugated fiberboard, plastic, papier-mâché, etc.). In some examples, the top element 118 is a decorative element and can be in a holiday-themed shape (e.g., a star, an angel, an ornament etc.). In some examples, the top element 118 can have graphics (e.g., an advertisement, information, holiday images, etc.) disposed onto the surface.

Figure 2:
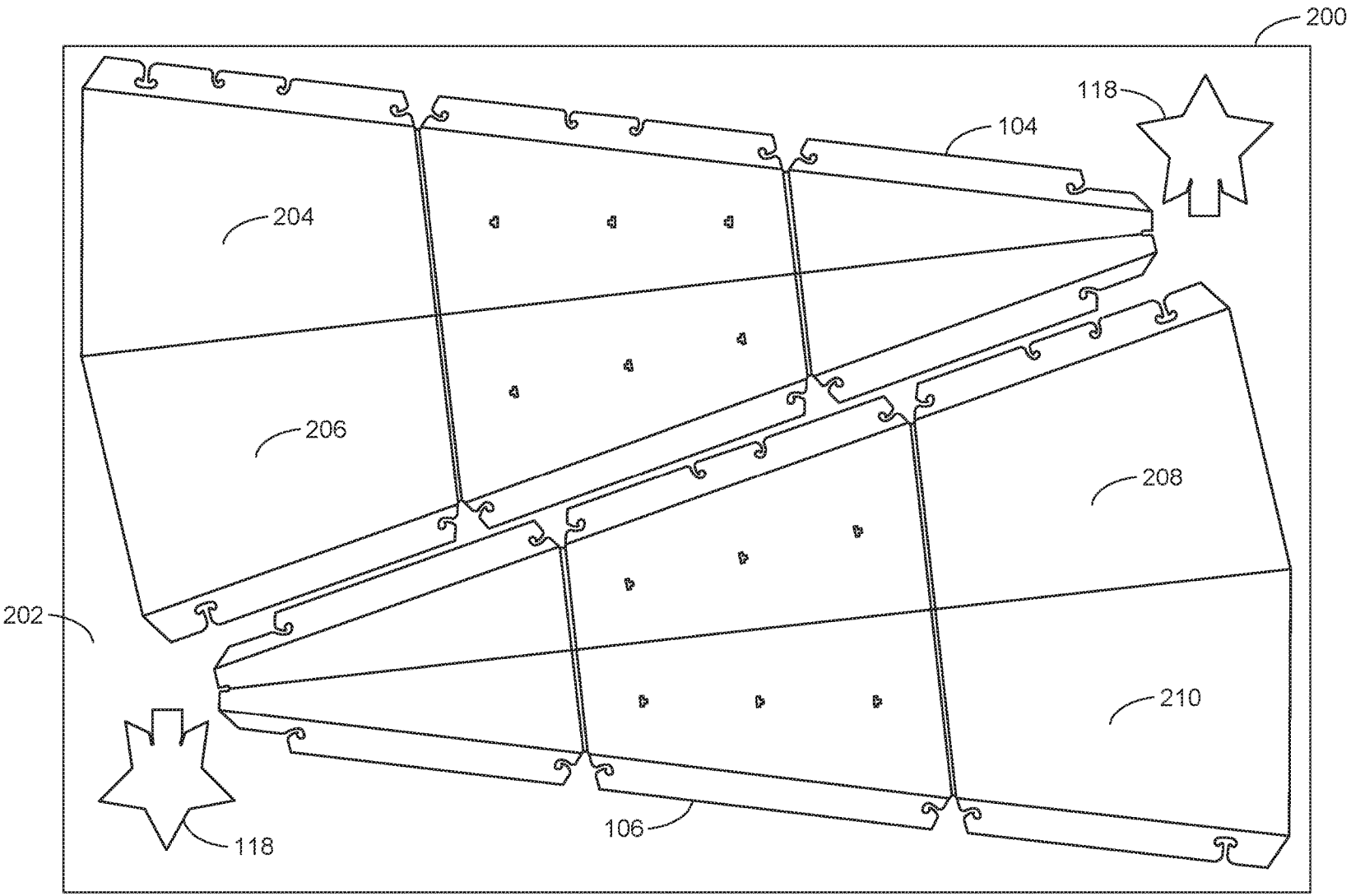
FIG. 2 is an illustration of an example web from which the components of the example display of FIG. 1 may be formed.

FIG. 2 is an illustrate of an example web 200 from which the components of the example display 100 of FIG. 1 may be formed. In the illustrated example, the web 200 includes the substrates 104, 106 and one or more top elements 118. In some examples, the base 116 can also be formed from the web 200. In other examples, the base 116 can be formed from a separate web. In other examples, the base 116 can be excluded from the display 100. After the components are formed from the web 200, an example waste material 202 is left. In some examples, additional components can be formed from the waste material 202. In some examples, some or all the components of the display 100 (e.g., the substrates 104, 106, the top element(s) 118, the base 116, one or more stops, etc.) can be formed from the web 200 through die cutting. In other examples, the components can be formed from the web 200 using any other suitable method (e.g., wire cutting, clicking, clinking, other automatic processes, or manually with scissors or other cutting instruments, etc.).

In the illustrated example, the first substrate 104 includes an example first panel 204 and an example second panel 206. The example second substrate 106 includes an example third panel 208 and an example fourth panel 210. In some examples, when the display 100 is assembled, the example first panel 204, the example second panel 206, the example third panel 208, and the example fourth panel 210 each form a side of the display 100. In other examples, the second panel 206 and the fourth panel 210 are subpanels (e.g., the second panel 206 and the forth panel have a smaller area than the first panel 204 and the third panel 208, etc.). In some such examples, when the display 100 is assembled, the display 100 has three sides (e.g., the display 100 is a triangle, etc.) wherein the first side is formed by the first panel 204, the second side is formed by the second panel 206 and the third side is formed by the second panel 206 and the fourth panel 210. In such examples, the second panel 206 and the fourth panel 210 may overlap or may be adjacent to each other.

Figure 3:
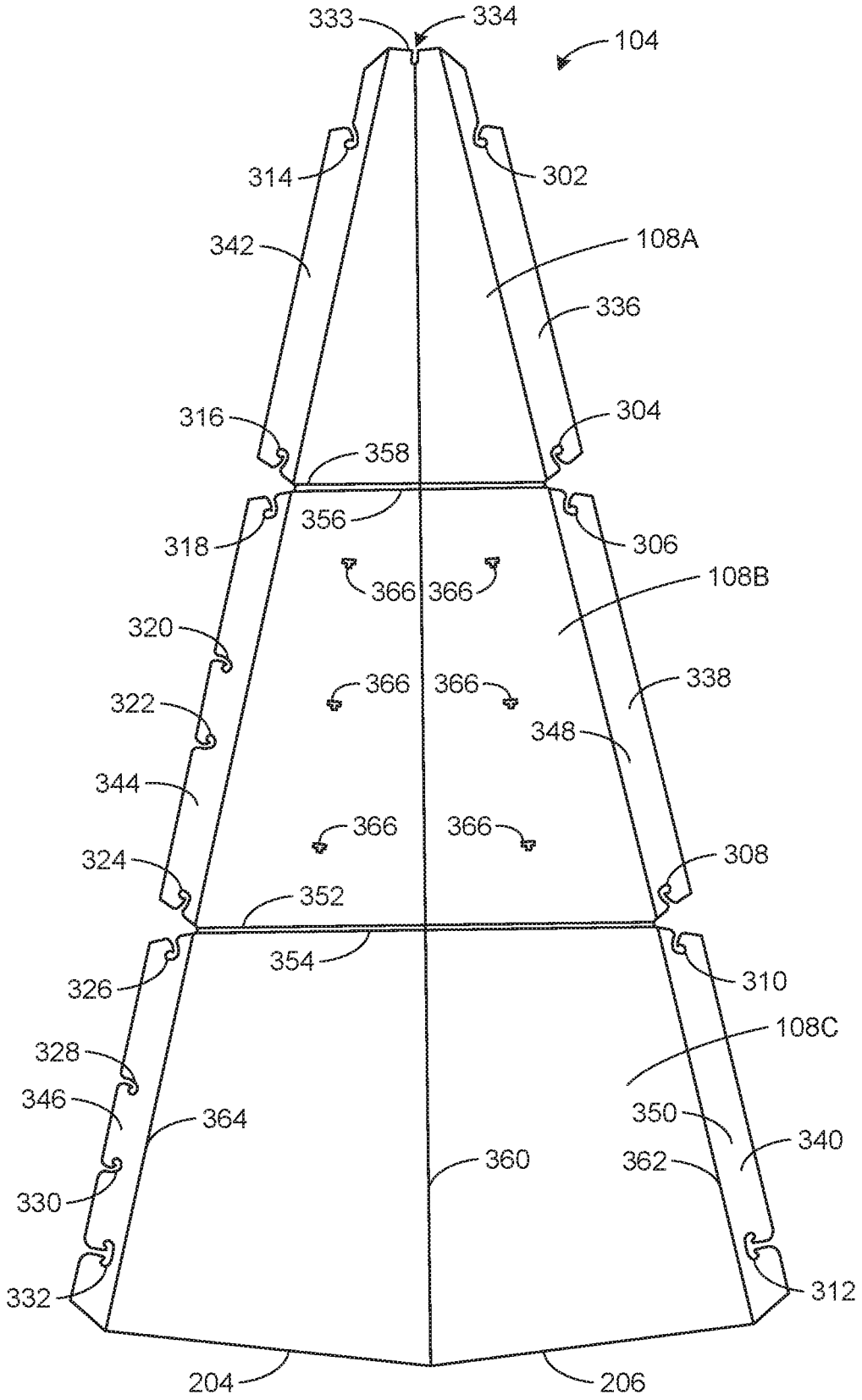
FIG. 3 is a plan view of an example substrate that can be used to implement the pyramidical display of FIG. 1.

FIG. 3 is a plan view of the example substrate 104 of FIG. 1 that can be used to implement the pyramidical display 100 of FIG. 1. The example substrate 104 includes the example segments 108A, 108B and 108C. In the illustrated example, the example first substrate 104 includes example apertures 302, 304, 306, 308, 310, 312, 314, 316, 318, 320, 322, 324, 326, 328, 330, 332. The example first substrate 104 further includes an example top edge 333 with an example top slot 334 that can be used to couple the example top element 118 to the substrate 104.

In the illustrated example, the first substrate 104 includes an example first flap 336, an example second flap 338, an example third flap 340, an example fourth flap 342, an example fifth flap 344, and an example sixth flap 346. In the illustrated example, the second flap 338 include an example first aperture-free area 348, and the third flap 340 includes an example second aperture-free area 350. While one configuration of apertures is depicted in FIG. 3, any other suitable configuration of apertures can be used to implement the example substrate 104. In some examples, the aperture-free areas 348, 350 can be absent from the flaps 338, 340 and/or included on any other suitable flap (e.g., the fifth flap 344 and/or sixth flap 346, etc.) In the illustrated example, the apertures 302, 304, 306, 308, 310, 312, 314, 316, 318, 320, 322, 324, 326, 328, 330, 332 have a narrow entry portion that expands to a relatively larger retainer portion. This example configuration of the apertures 302, 304, 306, 308, 310, 312, 314, 316, 318, 320, 322, 324, 326, 328, 330, 332 secures the elastic element(s) disposed thereon and prevents the dislodgement of the elastic element(s) disposed therein. In other examples, the apertures 302, 304, 306, 308, 310, 312, 314, 316, 318, 320, 322, 324, 326, 328, 330, 332 can be any suitable shape to allow an elastic element to be affixed and/or disposed thereon.

The example first substrate 104 further includes transverse axes 352, 354, 356, 358 and lines of weakness 360, 362, 364. In some examples, some or all of the transverse axes 352, 354, 356, 358 are lines of weakness that enables the substrate 104 and/or display 100 to be folded and/or flatten for storage and/or shipping. To erect the example display 100, the example substrate 104 is folded along the line of weakness 360 and coupled to another substrate (e.g., the example substrate 106, etc.). In some examples, the example flaps 336, 338, 340 are folded inward along the example line of weakness 362 and the example flaps 342, 344, 346 are folded inward along the example line of weakness 364. In the illustrated example, the first panel 204 is separated from the second panel 206 by the example line of weakness 360. In some examples, the third panel 208 and the fourth panel 210 can be similarly separated by a corresponding line of weakness of the second substrate 106.

The example flaps 336, 338, 340, 342, 344, 346 can be coupled to another substrate via biasing elements such as, for example, elastic bands and/or rubber bands. For example, the first flap 336 can be coupled to a corresponding flap of another substrate via a biasing element(s) extending longitudinally along the first flap 336 between the apertures 302, 304 and the apertures of the corresponding flap of the other substrate. The example second flap 338 can be coupled to a corresponding flap of another substrate via a biasing element(s) extending longitudinally along the second flap 338 between the apertures 306, 308 and the apertures of the corresponding flap of the other substrate. The example third flap 340 can be coupled to a corresponding flap of another substrate via a biasing element(s) extending longitudinally along the third flap 340 between the apertures 310, 312 and the apertures of the corresponding flap of the other substrate. The example fourth flap 342 can be coupled to a corresponding flap of another substrate via a biasing element(s) extending longitudinally along the fourth flap 342 between the apertures 314, 316 and the apertures of the corresponding flap of the other substrate. The example fifth flap 344 can be coupled to a corresponding flap of another substrate via a biasing element(s) extending longitudinally along the fifth flap 344 between the apertures 318, 324 and the apertures of the corresponding flap of the other substrate. The example sixth flap 346 can be coupled to a corresponding flap of another substrate via a biasing element(s) extending longitudinally along the sixth flap 346 between the apertures 326, 332 and the apertures of the corresponding flap of the other substrate. Additionally or alternatively, the flaps 336, 338, 340, 342, 344, 346 can be coupled to another substrate via any other suitable method (e.g., adhesive, staples, and/or other suitable chemical and/or mechanical fasteners, or combinations thereof). Though the illustrated example includes apertures 302, 304, 306, 308, 310, 314, 316, 318, 324, 326, 332, in some examples there may be fewer or more apertures disposed on the flaps 336, 338, 340, 342, 344, 346.

The example substrate 104 can be folded along the example line of weakness 360 to form a vertex of the pyramidical display 100 of FIG. 1. In some examples, to prevent rotation about the vertex formed by the line of weakness 360, one or more stops (e.g., the stops 400, 402 of FIG. 4, etc.) can be coupled to one or more of the example flaps 336, 338, 340, 342, 344, 346. For example, one or more stops can be coupled via an adhesive to the aperture-free areas 348, 350 of the second the third flaps 338, 340. In some examples, the stops can be further coupled to the fifth and sixth flaps 344, 346 via biasing elements, elastic bands and/or rubber bands extending between one or more of the apertures 320, 322, 328, 330 and apertures of the respective stop(s), as detailed below. In some examples, the coupling of the top element 118 to the first substrate 104 can similarly prevent rotation about the vertex formed by the line of weakness 360. For example, a portion of the top element 118 in contact with the first substrate 104 can inhibit the vertex formed by the line of weakness 360 from contracting. An example partial cross-section of the partially undeployed display 100 is described below in conjunction with FIG. 5A.

The example substrate 104 further includes example markings 366 to couple display elements to the substrate 104. For example, the markings 366 can be used to couple display hanger(s) to the substrate 104 (e.g., to display gift cards, brochures, etc.). In some examples, the markings 366 can be used to indicate a location to adhere a display element to an external face of the substrate 104. In some examples, the markings 366 are internal when the display 100 is formed (deployed). In some examples, the markings 366 are notches and/or flaps. In some examples, the markings 366 are formed when the substrate 104 is formed from the web 200. In other examples, the markings 366 can be formed by any suitable method.

Figure 4:
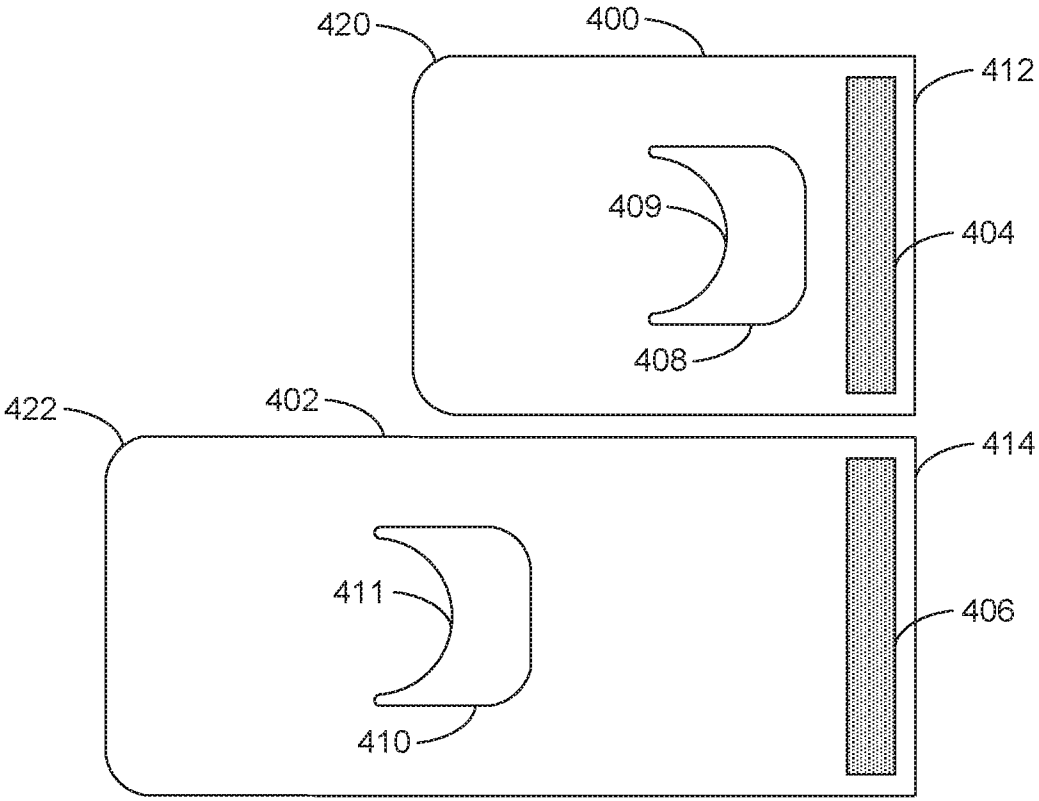
FIG. 4 is an illustration of example stops that may be used to implement the pyramidical display of FIG. 1.

FIG. 4 is an example illustration of example stops 400, 402 that may be used to implement the pyramidical display 100 of FIG. 1. The example stops 400, 402 can be coupled to pyramidical display 100 to urge the pyramidical display 100 into the erected or deployed position and/or to maintain the display 100 in the deployed position. In some examples, the first stop 400 is coupled to the shroud 102 at a higher vertical position than the second stop 402. Accordingly, the first stop 400 is smaller in length the second stop 402 as the cross-section of the pyramidical display 100 decreases along a vertical axis (e.g., an axis parallel to the line of weakness 360 of FIG. 3, etc.) of the pyramidical display 100.

The example stops 400, 402 can be coupled to the pyramidical display 100 via one or more biasing elements and/or adhesive. In some examples, the stops 400, 402 can be coupled to one or more vertexes of the display 100. In some examples, when erected, the display 100 can have four vertexes, a first vertex formed by the coupling of the first substrate 104 and the second substrate 106 via the flaps 342, 344, 346, a second vertex formed by the line of weakness 360, a third vertex formed by the coupling of the first substrate 104 and the second substrate via the flaps 336, 338, 340 and a forth vertex formed by a longitudinal line of weakness of the second substrate 106 corresponding to the line of weakness 360 in the first substrate 104. For example, the example stops 400, 402 can be coupled to the first vertex of the pyramidical display 100 via one or more biasing element(s) and the stops 400, 402 can be further coupled to the third vertex of the pyramidical display 100 via adhesive.

In the illustrated example, the stops 400, 402 include adhesive portions 404, 406 that enable the stops 400, 402 to be coupled to substrate 104. In some examples, the adhesive portions 404, 406 are joined at one or more of the flaps 336, 338, 340 of FIG. 3. Additionally or alternatively, the adhesive portions 404, 406 can be joined to any other suitable portion of the substrate 104. In some examples, the adhesive portions 404, 406 are on both the front and the back of the example stops 400, 402. In the illustrated example, the adhesive portions 404, 406 are on a single side of the example stops 400, 402. In some examples, the adhesive portions 404, 406 can be implemented as a glue, tape, epoxy, and/or other suitable type of chemical fastener. Additionally or alternatively, the example stops 400, 402 can be integral and/or contiguous with the at least one of the first substrate 104 and/or the second substrate 106. For example, the one or more flaps 336, 338, 340, 342, 344, 346 can include some or all of the elements of the stops 400, 402.

The stops 400, 402 can be further coupled to the substrate 104 using biasing elements including, for example, elastic bands, and/or rubber bands. The stops 400, 402 include apertures 408, 410 to receive and/or couple one or more elastic elements. In the illustrated example of FIG. 4, the example aperture 408 defines an example tab 409 and the example aperture 410 defines an example tab 411. The apertures 408, 410 are shaped in a manner that allows an end of a biasing element to be attached and extend longitudinally across the example tabs 409, 411. This example configuration of the apertures 408, 410 secures the biasing elements disposed on the tabs 409, 411 and prevents the dislodgement of the biasing elements. In some examples, the apertures 408, 410 can include notches to further retain the biasing elements. In other examples, the apertures 408, 410 and the tabs 409, 411 can be of any suitable shape to allow one or more biasing elements to be coupled to the stops 400, 402.

Figure 5A:
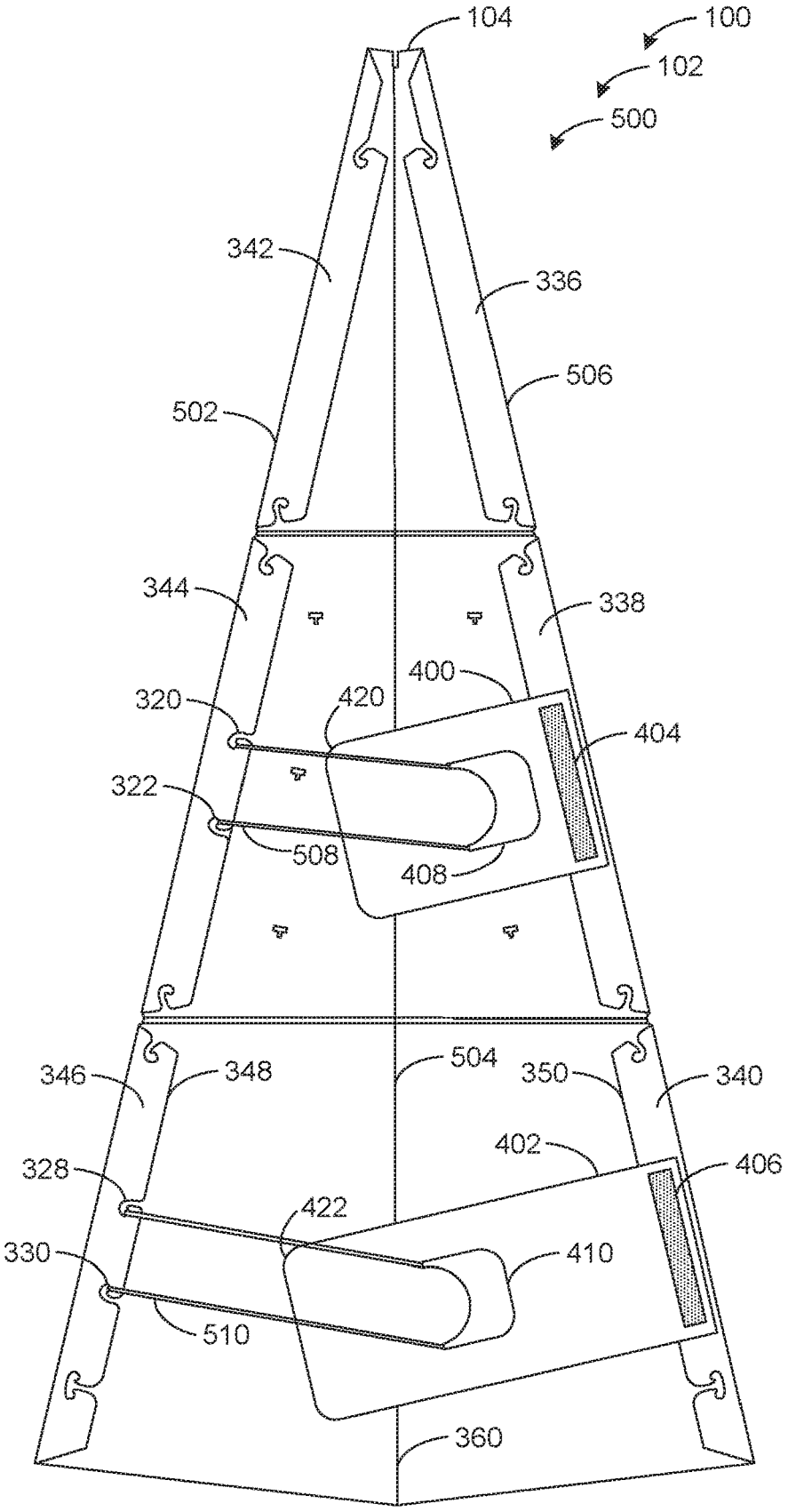
FIG. 5A is a cross-sectional view of a portion of the example pyramidical display of FIG. 1 in a partially undeployed state.

FIG. 5A is a cross-sectional view 500 of the example pyramidical display 100 of FIG. 1 in a partially undeployed state (e.g., the substrate 104 has been unfolded but remains flatten, unerected, etc.) The cross-section view 500 bisects the pyramidical display 100 through a plane parallel to a central axis of the display 100. In the illustrated example, the cross-section view 500 depicts the stops 400, 402 coupled to the first substrate 104. In the illustrated example, an example first vertex 502 is formed by the coupling of the flaps 342, 344, 346 of the example first substrate 104 to corresponding flap(s) of the second substrate 106. The first vertex 502 is formed of the line weakness 364. An example second vertex 504 is formed by folding the first substrate 104 about the example line of weakness 360. In the illustrated example, an example third vertex 506 is formed by the coupling of the flaps 336, 338, 340 to corresponding flaps of the second substrate 106. The third vertex 506 is formed of the line of weakness 362. In some examples, a fourth vertex is formed by folding the second substrate 106 about a line of weakness corresponding to the line of weakness 360.

In the illustrated example, the first stop 400 is coupled to the second flap 338 via the adhesive portion 404, and the second stop 402 is coupled to third flap 340 via the adhesive portion 406. In some examples, the coupling of the first stop 400 to the second flap 338 and the second stop 402 to the third flap 340 causes the stops 400, 402 to be permanently engaged to the third vertex 506. The first stop 400 is urged towards the first vertex 502 via an example biasing element 508 coupled to the first stop 400 via the aperture 408. The example biasing element 508 is further coupled to the fifth flap 344 via the apertures 320 and 322. Similarly, the second stop 402 is urged towards the first vertex 502 via an example biasing element 510 coupled to the second stop via the aperture 410. The example biasing element 510 is further coupled to the sixth flap 346 via the apertures 328 and 330.

In some examples, when the display 100 is deployed, the first stop 400 is at a higher vertical height than the second stop 402. In some examples, the length of the stops 400, 402 can correspond to the vertical height of the location in the shroud 102 to which the stops 400, 402 are coupled. In some examples, this configuration of the stops 400, 402 (e.g., the relatively shorter first stop 400 is at a higher vertical position than the relatively longer second stop 402, etc.) facilitates the reduced cross-sectional area of the shroud 102 at higher positions.

When deployed from the undeployed state depicted in FIG. 5A, the biasing elements 508, 510 contract and a portion of the stops 400, 402 (e.g., an example corner 420 of the stop 400 of FIG. 4, an example corner 422 of the stop 402 of FIG. 4, etc.) removably engage the first vertex 502. In the illustrated example, the stops 400, 402 intersect a central-axis of the shroud 102 (e.g., a projection of the vertex 504 onto the cross-sectional view 500, etc.) at a non-orthogonal angle (e.g., an acute angle, an obtuse angle). In other examples, the stops 400, 402 can be coupled to the shroud 102 in a manner that causes the stops 400, 402 to intersect a central-axis of the shroud 102 at an orthogonal angle.

In some examples, during assembly, the biasing elements 508, 510 urge the first substrate 104 to fold around the line of weakness 360 to form the second vertex 504. The biasing elements 508, 510 similarly urge the second substrate 106 to fold around a central line of weakness corresponding to the line of weakness 360. In some examples, the stops 400, 402 arrest the movement of the example display 100 when deployed, which ensures the interior of the display 100 maintains the desired shaped. In some examples, the biasing elements 508, 510 force the stops 400, 402 into removable engagement with the first vertex 502, which prevents the shroud 102, the first substrate 104, and the second substrate 106 from further rotating about the vertexes 502, 504, 506 (e.g., the angle associated with each vertex 502, 504, 506 remains constant, etc.).

Figures 5B, 5C:
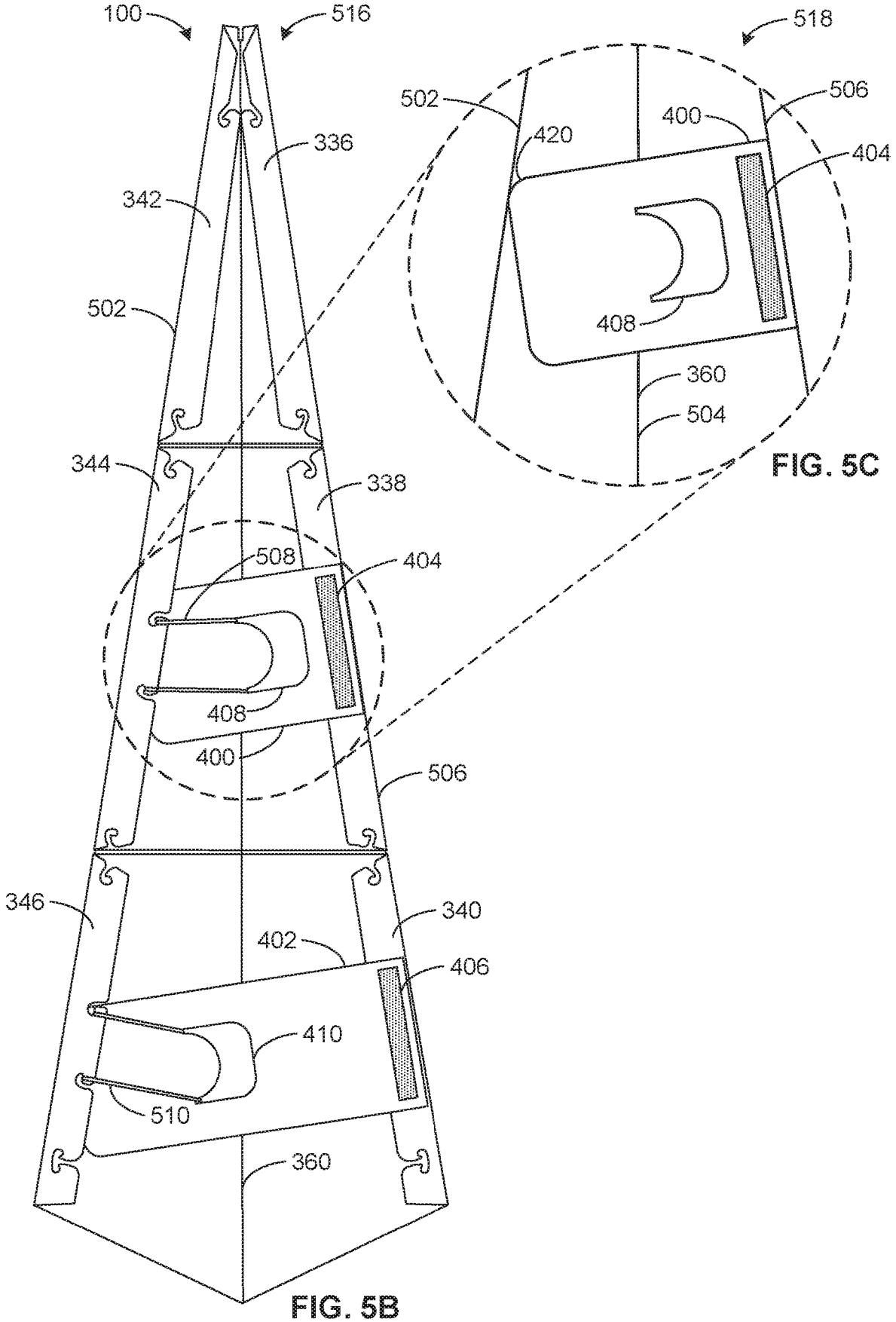
FIG. 5B is a cross-sectional view of a portion of the example pyramidical display of FIG. 1 in a deployed state.
FIG. 5C is a detail view of the encircled portion of the deployed example pyramidical display of FIG. 5B in a deployed state showing an engagement between the example stop 400 and the example vertex of the pyramidical display with an example flap removed for clarity.

FIG. 5B is a cross-sectional view 516 of a portion of the example pyramidical display 100 of FIG. 1 in a deployed state. The cross-section view 516 bisects the pyramidical display 100 through a plane parallel to a central axis of the display 100 (e.g., the same plane as the cross-section view 500 of FIG. 5A, etc.). In the illustrated example, the cross-section view 516 depicts the stops 400, 402 coupled to the first substrate 104 and removably engaged with the example vertex 502. In the illustrated example, the biasing element 508 urges a portion (e.g., the corner 420, etc.) of the example stop 400 to contact the example vertex 502. Similarly, in the illustrated example, the biasing element 510 urges a portion (e.g., the corner 422, etc.) of the stop 402 to contact the example vertex 502. In some examples, the removable engagement of the stops 400, 402 to the vertex 502 prevents the example display 100 from rotating about the central axis of the display 100.

FIG. 5C is a detail view 518 of the encircled portion of the example pyramidical display 100 of FIG. 5B, in which the pyramidical display is in the deployed state showing an engagement between the example stop 400 and the example vertex 502 of the pyramidical display 100. In the illustrated example, the corner 420 of the example stop 400 is removably engaged with the vertex 502. In the illustrated example of FIG. 5C, the flaps 338, 344 are not illustrated for clarity. In some examples, the stop 400 can be disposed between the flap 338 and the flap of the corresponding substrate coupled to the flap 338. In other examples, the stop 400 can be disposed adjacent to the flap 338 or the flap of the corresponding substrate coupled to the flap 338. In some examples, the corner 422 of the stop 402 can be similarly engaged with the vertex 502.

Figure 6:
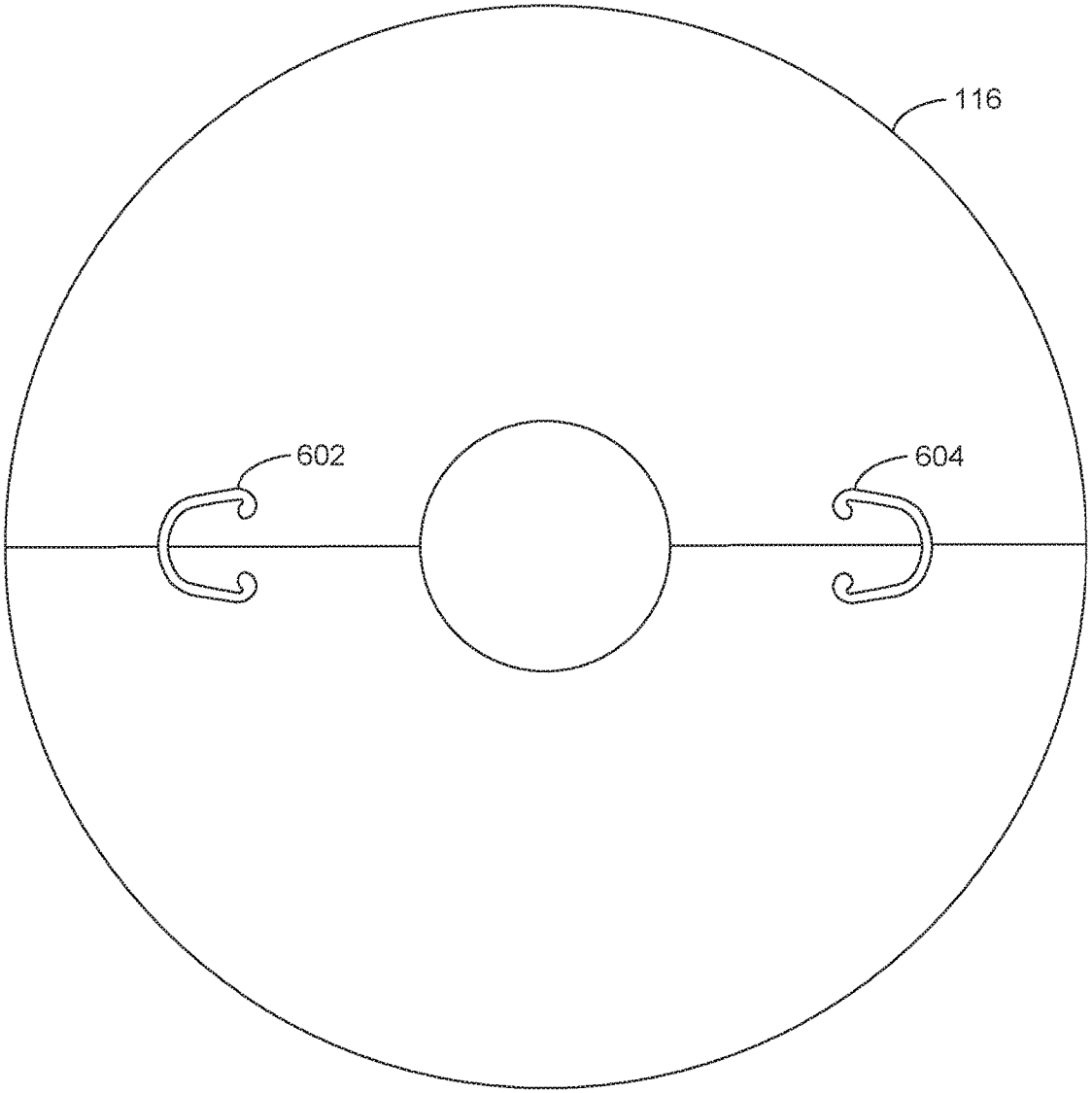
FIG. 6 is an illustration of example base that can be used to implement the pyramidical display of FIG. 1.

FIG. 6 is an example illustration of example base 116 that can be used to implement the pyramidical display 100 of FIG. 1. In the illustrated example, the example base 116 includes example apertures 602, 604. The example base 116 is coupled to the shroud 102 to increase the stability of the example pyramidical display 100 and to help maintain the shroud 102 in a desired orientation (e.g., upright, etc.). In the illustrated example, the base 116 is a circle. In other examples, the base 116 can be any other suitable shape (e.g., a quadrilateral, a triangle, an oval, etc.). In the illustrated example, the base 116 is composed of a single portion of material (e.g., card stock, paperboard, corrugated fiberboard, etc.). In other examples, the base 116 can be composed of a plurality of segments. In this example, the segments of the base 116 can be composed of different materials.

The example base 116 may be coupled to the display 100 using one or more biasing element coupled to base 116 and the example shroud 102. In some examples, the base 116 is coupled to the substrates 104, 106 by a first elastic band coupled between the aperture 602 and the aperture 332 and a second elastic band coupled between the aperture 604 and the aperture 312.

Figure 7:
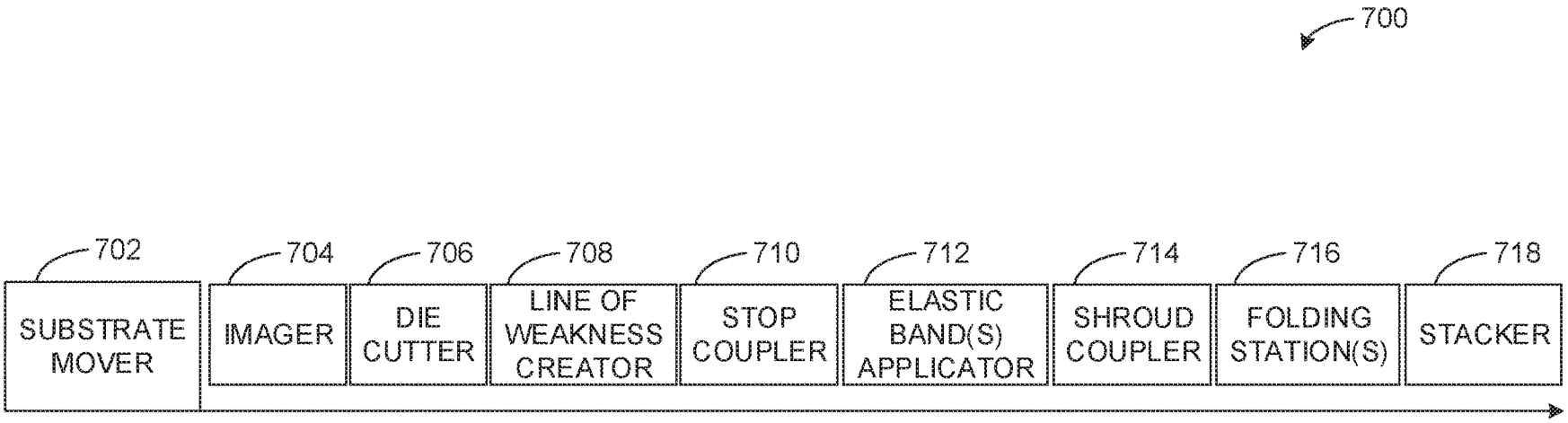
FIG. 7 is a block diagram of an example apparatus that can be used to produce the pyramidical display of FIG. 1 disclosed herein.

FIG. 7 illustrates an example apparatus 700 that can be used to produce the pyramidical display 100 disclosed herein. In some examples, the apparatus 700 performs an in-line process that includes processes to produce an example shroud 102 in accordance with the teachings of this disclosure and processes to produce the example display 100 in accordance with the teachings of this disclosure. While the processes disclosed herein are described in connection with automatic processes, any and/or all of the processes disclosed may instead be implemented manually.

In this example, the example apparatus 700 includes elements to produce the example shroud 102 and/or the example display 100 including, for example, an example substrate mover 702, an example imager 704, an example die cutter 706, an example lines of weakness creator 708, an example stop coupler 710, an example elastic band applicator 712, an example shroud coupler 714, an example folding station 716, and an example stacker 718.

To produce an example shroud 102 in accordance with the teachings of this disclosure, in some examples, the substrate mover 702 feeds one or more pieces of substrate and/or a web (e.g., the web 200 of FIG. 2, etc.) into the apparatus 700.

In some examples, the imager 704 images a first and/or a second side of the web 200 and/or a substrate(s) such as, for example, the example shroud 102, substrates 104, 106, the example base 116 and/or the top element 118. The images can include graphics, brand-related images and/or text, advertising-related images and/or text, point-of-purchase-related images and/or text, instructional images and/or text, and/or any other desired indicia. In some examples, the imaged graphics can be winter holiday themed.

The die cutter 706 forms one or more apertures and/or notches within the shroud 102 and/or the substrates 104, 106 such as, for example, the example apertures 302, 304, 306, 308, 310, 312, 314, 316, 318, 320, 322, 324, 326, 328, 330, 332. In some examples, the die cutter 706 forms substrates 104, 106 as illustrated in FIGS. 1 and 3 and, more generally, substrates 104, 106 as disclosed herein from the web 200 of FIG. 2. In some examples, the die cutter 706 forms the top element 118, base 116 of FIG. 6, and/or the stops 400, 402 of FIG. 4.

The lines of weakness creator 708 forms one or more lines of weakness 112, 114, 360, 362, 364 on first and/or second sides of the web 200 and/or the elongate substrate(s) 104, 106 using a die(s), a cutting tool(s), a scoring tool(s), a slotting tool(s), etc.

The stop coupler 710 couples one or more of the stops 400, 402 on the shroud blank and/or to the elongate substrate(s) 104, 106.

The elastic band applicator 712 couples one or more elastic band(s), or other biasing elements, to one or more apertures 302, 304, 306, 308, 310, 312, 314, 316, 318, 320, 322, 324, 326, 328, 330, 332 defined by the shroud 102. In some examples, the elastic band applicator 712 couples one or more biasing elements 508, 510, 512, 514 between a stop 400, 402 and flap(s) 344, 346. In some examples, the elastic band applicator 712 couples one or more biasing elements 508, 510, 512, 514 between side edges and/or vertexes 502, 506 and an opposing side of the self-erectable displays 100. In some examples, the elastic bands include barbs to facilitate coupling the elastic bands to the flap apertures 302, 304, 306, 308, 310, 312, 314, 316, 318, 320, 322, 324, 326, 328, 330, 332 and retention therein. In some examples, the elastic band applicator 712 apples an elastic band to couple the example base 116 to the example shroud 102. In some examples, the elastic band applicator 712 applies an elastic band to couple the example top element 118 to the example shroud 102.

In some examples, the shroud coupler 714 forms a shroud 102 by folding the shroud 102 about its respective lines of weakness 112, 114, 360, 362, 364 and coupling the first substrate 104 and the second substrate flaps.

The folding station 716 flattens and/or folds the pyramidical display 100 about longitudinal axes of the shroud 102 and/or folds the pyramidical display 100 about transverse axes 352, 354, 356, 358 of the shroud 102 for storage and/or shipping.

The stacker 718 stacks the pyramidical display 100 for storage and/or shipping, etc. In some examples, the processes implemented by the stop coupler 710, the elastic band applicator 712, the shroud coupler 714, the folding station 716 and/or the stacker 718 are performed manually. In examples in which the stop is integral to the shroud 102 and/or the elongated substrate(s) 104, 106, the stop coupler 710 may be excluded.

While an example manner of implementing the apparatus 700 of FIG. 7 is illustrated in FIG. 7, one or more of the elements, processes and/or devices illustrated in FIG. 7 may be combined, divided, re-arranged, omitted, eliminated and/or implemented in any other way. Further, the example substrate mover 702, an example imager 704, an example die cutter 706, an example lines of weakness creator 708, an example stop coupler 710, an example elastic band applicator 712, an example shroud coupler 714, an example folding station 716, and an example stacker 718 and/or, more generally, the example apparatus 700 of FIG. 7 may be implemented by hardware, software, firmware and/or any combination of hardware, software and/or firmware. Thus, for example, any of the example substrate mover 702, an example imager 704, an example die cutter 706, an example lines of weakness creator 708, an example stop coupler 710, an example elastic band applicator 712, an example shroud coupler 714, an example folding station 716 and an example stacker 718, and/or, more generally, the example apparatus 700 could be implemented by one or more analog or digital circuit(s), logic circuits, programmable processor(s), programmable controller(s), graphics processing unit(s) (GPU(s)), digital signal processor(s) (DSP(s)), application specific integrated circuit(s) (ASIC(s)), programmable logic device(s) (PLD(s)), and/or field programmable logic device(s) (FPLD(s)). When reading any of the apparatus or system claims of this patent to cover a purely software and/or firmware implementation, at least one of the example substrate mover 702, an example imager 704, an example die cutter 706, an example lines of weakness creator 708, an example stop coupler 710, an example elastic band applicator 712, an example shroud coupler 714, an example folding station 716, and an example stacker 718 is/are hereby expressly defined to include a non-transitory computer readable storage device or storage disk such as a memory, a digital versatile disk (DVD), a compact disk (CD), a Blu-ray disk, etc. including the software and/or firmware. Further still, the example apparatus 700 of FIG. 7 may include one or more elements, processes and/or devices in addition to, or instead of, those illustrated in FIG. 7, and/or may include more than one of any or all of the illustrated elements, processes and devices. As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

Figure 8:
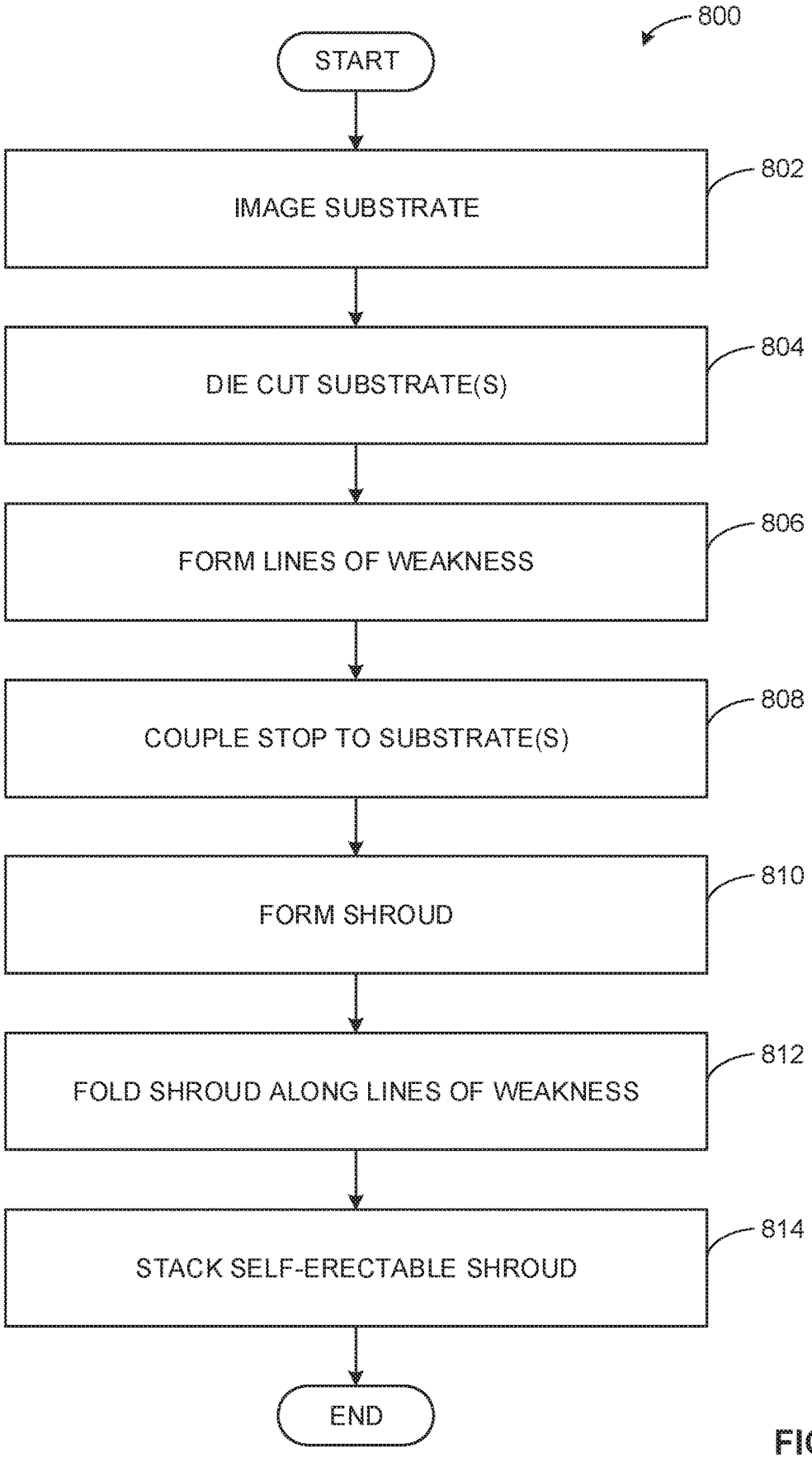
FIG. 8 is a flowchart representative of machine readable instructions which may be executed to implement the apparatus of FIG. 7.

A flowchart representative of example hardware logic, machine readable instructions, hardware implemented state machines, and/or any combination thereof for implementing the apparatus 700 of FIG. 7 is shown in FIG. 8. The machine readable instructions may be an executable program or portion of an executable program for execution by a computer processor such as the processor 912 shown in the example processor platform 900 discussed below in connection with FIG. 9. The program may be embodied in software stored on a non-transitory computer readable storage medium such as a CD-ROM, a floppy disk, a hard drive, a DVD, a Blu-ray disk, or a memory associated with the processor 912, but the entire program and/or parts thereof could alternatively be executed by a device other than the processor 912 and/or embodied in firmware or dedicated hardware. Further, although the example program is described with reference to the flowchart illustrated in FIG. 8, many other methods of implementing the example apparatus 700 may alternatively be used. For example, the order of execution of the blocks may be changed, and/or some of the blocks described may be changed, eliminated, or combined. Additionally or alternatively, any or all of the blocks may be implemented by one or more hardware circuits (e.g., discrete and/or integrated analog and/or digital circuitry, an FPGA, an ASIC, a comparator, an operational-amplifier (op-amp), a logic circuit, etc.) structured to perform the corresponding operation without executing software or firmware.

As mentioned above, the example process 700 of FIG. 7 may be implemented using executable instructions (e.g., computer and/or machine readable instructions) stored on a non-transitory computer and/or machine readable medium such as a hard disk drive, a flash memory, a read-only memory, a compact disk, a digital versatile disk, a cache, a random-access memory, and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

The program 800 of FIG. 8 includes block 802. At block 802, the imager 704 images the substrates 104, 106. For example, the imager 704 may image the substrates 104, 106 with brand-related images and/or text, advertising-related images and/or text, point-of-purchase-related images and/or text, instructional images and/or other text, indicia and/or images.

At block 804, the die cutter 706 die cuts the example substrate 104, 106 from the web 200. For example, the die cutter 706 can cut the substrates 104, 106 to form the apertures 302, 304, 306, 308, 310, 312, 314, 316, 318, 320, 322, 324, 326, 328, 330, 332, top slot 334 and/or cuts the substrates 104, 106 from the web 200. The die cutter 3306 may also be used to form notches, eyelets, apertures 302, 304, 306, 308, 310, 312, 314, 316, 318, 320, 322, 324, 326, 328, 330, 332. The die cutter 706 further can be used to form the stops 400, 402, the base 118, and the top element(s) 118. At block 806, the line of weakness creator 708 forms one or more lines of weakness 112, 114, 360, 362, 364 on the first substrate 104 and the second substrate 106 using a die(s), a cutting tool(s), a scoring tool(s), a slotting tool(s), etc.

At block 808, the stop coupler 710 couples the stop(s) 400, 402 to the substrates 104, 106. For example, the stop coupler 710 can couple one or more of the stops 400, 402 to one or more of the example flap 336, 338, 340, 342, 344, 346 of the substrates 104, 106. In some examples, the stop coupler 710 can couple the stops 400, 402 to the substrates 104, 106 using an adhesive and/or an elastic band.

At block 810, the shroud coupler 714 forms the shroud 102. For example, the shroud coupler 714 can fold the shroud 102 about the lines of weakness 112, 114, 360, 362, 364 and can join the flaps of the first substrate 104 (e.g., the flaps 336, 338, 340, 342, 344, 346, etc.) and corresponding flaps of the second substrate 106. In some examples, the shroud coupled 714 can join the flaps of the first substrate 104 and the corresponding flaps of the second 106 using biasing elements, adhesive, and/or any other suitable method. In other examples, the elastic band applicator 712 can couple respective pairs of inwardly facing flaps using elastic bands.

At block 812, the folding station 716 folds the shroud 102 along lines of weakness 112, 114, 360, 362, 364. For example, the folding station 716 can fold and/or flatten the pyramidical display 100 about the longitudinal axes of the shroud 102 and/or the transverse axis of the 102 for storage and/or shipping. At block 814, the stacker 718 stacks the pyramidical display 100 for storage, shipping, etc.

Figure 9:
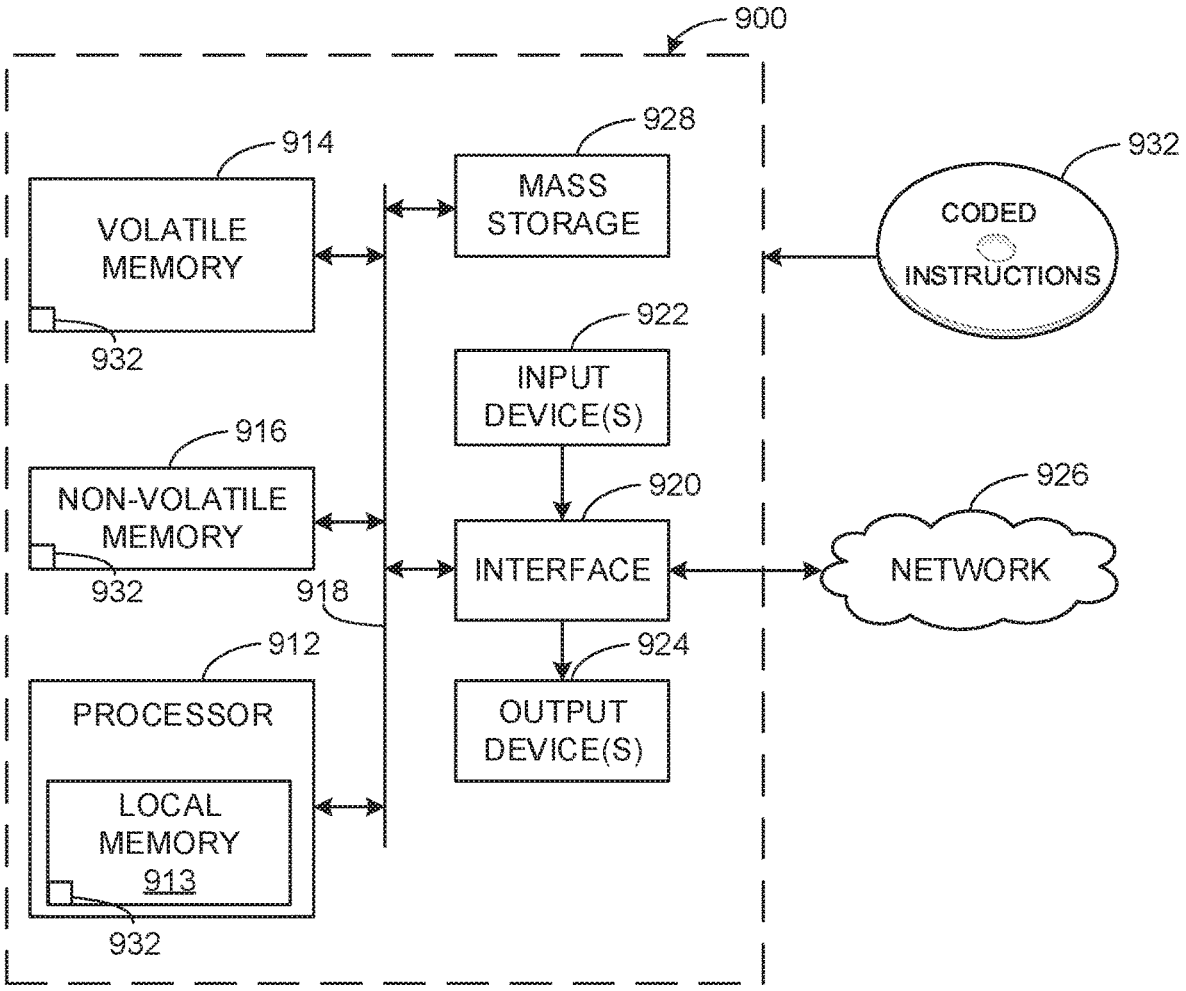
FIG. 9 is a block diagram of an example processing platform structured to execute the instructions of FIG. 8 to implement the apparatus of FIG. 7.

FIG. 9 is a block diagram of an example processor platform 900 structured to execute the instructions of FIG. 8 to implement the apparatus 700 of FIG. 7. The processor platform 700 can be, for example, a server, a personal computer, a workstation, a self-learning machine (e.g., a neural network), or any other type of computing device.

The processor platform 900 of the illustrated example includes a processor 912. The processor 912 of the illustrated example is hardware. For example, the processor 912 can be implemented by one or more integrated circuits, logic circuits, microprocessors, GPUs, DSPs, or controllers from any desired family or manufacturer. The hardware processor may be a semiconductor based (e.g., silicon based) device. In this example, the processor implements one or more aspects of the substrate mover 702, the imager 704, the die cutter 706, the lines of weakness creator 708, the stop coupler 710, the elastic band applicator 712, the shroud coupler 714, the folding station 716, and/or the stacker 718.

The processor 912 of the illustrated example includes a local memory 913 (e.g., a cache). The processor 912 of the illustrated example is in communication with a main memory including a volatile memory 914 and a non-volatile memory 916 via a bus 918. The volatile memory 914 may be implemented by Synchronous Dynamic Random Access Memory (SDRAM), Dynamic Random Access Memory (DRAM), RAMBUS® Dynamic Random Access Memory (RDRAM®), and/or any other type of random access memory device. The non-volatile memory 916 may be implemented by flash memory and/or any other desired type of memory device. Access to the main memory 914, 916 is controlled by a memory controller.

The processor platform 900 of the illustrated example also includes an interface circuit 920. The interface circuit 920 may be implemented by any type of interface standard, such as an Ethernet interface, a universal serial bus (USB), a Bluetooth® interface, a near field communication (NFC) interface, and/or a PCI express interface.

In the illustrated example, one or more input devices 922 are connected to the interface circuit 920. The input device(s) 922 permit(s) a user to enter data and/or commands into the processor 1012. The input device(s) can be implemented by, for example, an audio sensor, a microphone, a camera (still or video), a keyboard, a button, a mouse, a touchscreen, a track-pad, a trackball, isopoint, and/or a voice recognition system.

One or more output devices 924 are also connected to the interface circuit 920 of the illustrated example. The output devices 924 can be implemented, for example, by display devices (e.g., a light emitting diode (LED), an organic light emitting diode (OLED), a liquid crystal display (LCD), a cathode ray tube display (CRT), an in-place switching (IPS) display, a touchscreen, etc.), a tactile output device, a printer, and/or speaker. The interface circuit 920 of the illustrated example, thus, typically includes a graphics driver card, a graphics driver chip, and/or a graphics driver processor.

The interface circuit 920 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 926. The communication can be via, for example, an Ethernet connection, a digital subscriber line (DSL) connection, a telephone line connection, a coaxial cable system, a satellite system, a line-of-site wireless system, a cellular telephone system, etc.

The processor platform 900 of the illustrated example also includes one or more mass storage devices 928 for storing software and/or data. Examples of such mass storage devices 928 include floppy disk drives, hard drive disks, compact disk drives, Blu-ray disk drives, redundant array of independent disks (RAID) systems, and digital versatile disk (DVD) drives.

The machine executable instructions 800 of FIG. 8 may be stored in the mass storage device 928, in the volatile memory 914, in the non-volatile memory 916, and/or on a removable non-transitory computer readable storage medium such as a CD or DVD.

Example 1 includes an apparatus, comprising a first panel, a second panel, a third panel, a fourth panel, when in an erected position, the first panel, the second panel, the third panel and the fourth panel form a first cross-section at a first height and a second cross-section at a second height, the first cross-section having a greater area than the second cross-section, the first height lower than the second height, and a first stop extending between a first vertex between the first panel and the third panel and a second vertex between the second panel and the fourth panel, the first stop to prevent movement of the first panel about the first vertex.

Example 2 includes the apparatus of example 1, further including a first substrate and a second substrate, the first substrate including the first panel and the second panel, the second substrate including the third panel and the fourth panel.

Example 3 includes the apparatus of example 2, wherein the first substrate has a top edge with a slot, the slot to fit a top element.

Example 4 includes the apparatus of example 2, wherein the first substrate has a first flap and a second flap, and the second substrate has a third flap and a fourth flap, the first flap coupled to the third flap to form the first vertex and the second flap coupled to the fourth flap to form the second vertex.

Example 5 includes the apparatus of example 2, wherein the first panel is separated from the second panel by a first line of weakness and the third panel is separated from the fourth panel by a second line of weakness.

Example 6 includes the apparatus of example 1, further including a second stop extending between the first vertex and second vertex, the first stop smaller in length than the second stop.

Example 7 includes the apparatus of example 1, the first stop is at an acute angle with reference to a central axis of the first cross-section.

Example 8 includes an apparatus, including a shroud including a first substrate, a second substrate and an interior formed between the first substrate and the second substrate, the interior having a first cross-sectional area at a first height and a second cross-sectional area at a second height, the first cross-sectional area smaller than the second cross-sectional area, the first height lower than the second height, a first stop coupled to the first substrate at the first height, and a second stop coupled to the second substrate at the second height, the first stop and the second stop preventing the first substrate from rotating with respect to the second substrate.

Example 9 includes the apparatus of example 8, wherein the first substrate includes a first panel and a second panel separated by a first line of weakness, the second substrate includes a third panel and a fourth panel separated by a second line of weakness, and the interior has a polygonal cross-section.

Example 10 includes the apparatus of example 9, wherein the first line of weakness forms a first vertex when the apparatus is erected and the second line of weakness forms a second vertex when the apparatus is erected.

Example 11 includes the apparatus of example 8, wherein the first stop and the second stop are contiguous with the first substrate.

Example 12 includes the apparatus of example 8, wherein the interior has a central axis, the first stop intersecting the central axis at a non-orthogonal angle.

Example 13 includes the apparatus of example 10, wherein the first stop is permanently engaged with a third vertex of the shroud and removably engaged with a fourth vertex of the shroud, the third vertex and the fourth vertex formed by intersections of the first substrate and the second substrate.

Example 14 includes the apparatus of example 13, wherein the removable engagement of the first stop is enabled by a biasing element coupled to the first stop, the biasing element intersecting with the central axis at a non-orthogonal.

Example 15 includes an apparatus, including a shroud including a first substrate and a second substrate, a first stop coupled to the shroud at a first height, and a second stop coupled to the shroud at a second height, the second stop longer in length than the first stop, the first height greater than the second height.

Example 16 includes the apparatus of example 15, wherein at least one of the first stop or the second stop intersects with a central axis of the shroud at a non-orthogonal angle.

Example 17 includes the apparatus of example 15, wherein the first stop is permanently engaged with a first vertex of the shroud and removably engaged with a second vertex of the shroud.

Example 18 includes the apparatus of example 17, wherein the removable engagement of the first stop is enabled by a biasing element coupled to the first stop, the biasing element intersecting with the central axis at a non-orthogonal angle.

Example 19 includes the apparatus of example 17, wherein the first stop and the second stop are simultaneously removably engaged with the second vertex during deployment of the apparatus.

Example 20 includes the apparatus of example 15, wherein the first stop has a first edge and a second edge parallel to the first edge, the second edge having a first corner and a second corner, the first edge coupled to the first vertex, the first corner being removably engaged with the second vertex, and the second corner spaced from the second vertex when the first corner engages the second vertex.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus, comprising:

a first panel;

a second panel;

a third panel;

a fourth panel, when in an erected position, the first panel, the second panel, the third panel and the fourth panel form a first cross-section at a first height and a second cross-section at a second height, the first cross-section having a greater area than the second cross-section, the first height lower than the second height; and a first stop extending between a first vertex between the first panel and the third panel and a second vertex between the second panel and the fourth panel, the first stop to prevent movement of the first panel about the first vertex, the first stop is at an acute angle with reference to a central axis of the first cross-section.

2. The apparatus of claim 1, further including a first substrate and a second substrate, the first substrate including the first panel and the second panel, the second substrate including the third panel and the fourth panel.

3. The apparatus of claim 2, wherein the first substrate has a top edge with a slot, the slot to fit a top element.

4. The apparatus of claim 2, wherein the first substrate has a first flap and a second flap, and the second substrate has a third flap and a fourth flap, the first flap coupled to the third flap to form the first vertex and the second flap coupled to the fourth flap to form the second vertex.

5. The apparatus of claim 2, wherein the first panel is separated from the second panel by a first line of weakness and the third panel is separated from the fourth panel by a second line of weakness.

6. The apparatus of claim 1, further including a second stop extending between the first vertex and second vertex, the first stop smaller in length than the second stop.

7. An apparatus, including:

a shroud including a first substrate, a second substrate and an interior formed between the first substrate and the second substrate, the interior having a first cross-sectional area at a first height and a second cross-sectional area at a second height, the first cross-sectional area smaller than the second cross-sectional area, the first height higher than the second height;

a first stop coupled to the first substrate at the first height, the interior having a central axis, the first stop intersecting the central axis at a non-orthogonal angle; and a second stop coupled to the second substrate at the second height, the first stop and the second stop preventing the first substrate from rotating with respect to the second substrate.

8. The apparatus of claim 7, wherein the first substrate includes a first panel and a second panel separated by a first line of weakness, the second substrate includes a third panel and a fourth panel separated by a second line of weakness, and the interior has a polygonal cross-section.

9. The apparatus of claim 8, wherein the first line of weakness forms a first vertex when the apparatus is erected and the second line of weakness forms a second vertex when the apparatus is erected.

10. The apparatus of claim 9, wherein the first stop is permanently engaged with a third vertex of the shroud and removably engaged with a fourth vertex of the shroud, the third vertex and the fourth vertex formed by intersections of the first substrate and the second substrate.

11. The apparatus of claim 10, wherein the removable engagement of the first stop is enabled by a biasing element coupled to the first stop, the biasing element intersecting with the central axis at a non-orthogonal angle.

12. The apparatus of claim 7, wherein the first stop and the second stop are contiguous with the first substrate.

13. An apparatus, including:

a shroud including a first substrate and a second substrate;

a first stop coupled to the shroud at a first height; and a second stop coupled to the shroud at a second height, the second stop longer in length than the first stop, the first height greater than the second height, at least one of the first stop or the second stop intersects with a central axis of the shroud at a non-orthogonal angle.

14. The apparatus of claim 13, wherein the first stop is permanently engaged with a first vertex of the shroud and removably engaged with a second vertex of the shroud.

15. An apparatus, including:

a shroud including a first substrate and a second substrate;

a first stop coupled to the shroud at a first height; and a second stop coupled to the shroud at a second height, the second stop longer in length than the first stop, the first height greater than the second height, wherein the first stop is permanently engaged with a first vertex of the shroud and removably engaged with a second vertex of the shroud, the removable engagement of the first stop is enabled by a biasing element coupled to the first stop, the biasing element intersecting with a central axis of the shroud at a non-orthogonal angle.

16. The apparatus of claim 14, wherein the first stop and the second stop are simultaneously removably engaged with the second vertex during deployment of the apparatus.

17. An apparatus, including:

a shroud including a first substrate and a second substrate;

a first stop coupled to the shroud at a first height; and a second stop coupled to the shroud at a second height, the second stop longer in length than the first stop, the first height greater than the second height, wherein the first stop has a first edge and a second edge parallel to the first edge, the second edge having a first corner and a second corner, the first edge coupled to a first vertex of the shroud, the first corner being removably engaged with a second vertex of the shroud, and the second corner spaced from the second vertex when the first corner engages the second vertex.

* * * * *